US007905984B2

(12) United States Patent
Thoröe Scherb et al.

(10) Patent No.: US 7,905,984 B2
(45) Date of Patent: Mar. 15, 2011

(54) PROCESS AND APPARATUS FOR PRODUCING A FIBROUS WEB

(75) Inventors: Thomas Thoröe Scherb, Sao Paulo (BR); Liuz Carlos Da Silva, Campo Limpo (BR)

(73) Assignee: Voith Patent GmbH, Heidenhelm (DE)

( * ) Notice: Subject to any disclaimer, the term of this patent is extended or adjusted under 35 U.S.C. 154(b) by 0 days.

(21) Appl. No.: 12/412,839

(22) Filed: Mar. 27, 2009

(65) Prior Publication Data

US 2009/0183847 A1 Jul. 23, 2009

Related U.S. Application Data

(63) Continuation of application No. 10/299,781, filed on Nov. 20, 2002, now Pat. No. 7,591,925.

(30) Foreign Application Priority Data

Nov. 23, 2001 (DE) ..... 101 57 451

(51) Int. Cl.
*D21H 11/00* (2006.01)

(52) U.S. Cl. ..... 162/111; 162/113; 162/117; 162/118

(58) Field of Classification Search ..... 162/111, 162/113, 280, 358.3, 117, 118
See application file for complete search history.

(56) References Cited

U.S. PATENT DOCUMENTS

| | | | |
|---|---|---|---|
| 4,356,059 | A | 10/1982 | Hostetler |
| 4,420,372 | A | 12/1983 | Hostetler |
| 4,689,119 | A | 8/1987 | Weldon |
| 4,849,054 | A | 7/1989 | Klowak |
| 5,776,307 | A | 7/1998 | Ampulski et al. |
| 5,830,316 | A | 11/1998 | Ampulski |
| 6,051,105 | A | 4/2000 | Ampulski |
| 6,210,528 | B1 | 4/2001 | Wolkowicz |
| 6,287,426 | B1 | 9/2001 | Edwards et al. |

FOREIGN PATENT DOCUMENTS

| | | |
|---|---|---|
| CA | 1 183 709 | 3/1985 |
| DE | 3 209 5 11 | 10/1982 |
| DE | 195 48 747 | 7/1997 |
| EP | 1 125 024 | 2/2003 |
| GB | 2 098 637 | 11/1982 |
| WO | 00/14330 | 3/2000 |
| WO | 01/40574 | 6/2001 |
| WO | 02/068753 | 9/2002 |

OTHER PUBLICATIONS

Paper Vocabulary TNC 92 SS 15 20 05, ISBN 91-7162-333-7; p. 247.

*Primary Examiner* — Mark Halpern

(74) *Attorney, Agent, or Firm* — Greenblum & Bernstein, P.L.C.

(57) ABSTRACT

Process and apparatus for producing a fibrous web in an apparatus that includes at least one nip formed between a smooth roll and at least one opposing element, a felt and an embossing belt. The process includes guiding the fibrous web and the felt through the at least one press nip formed between the smooth roll and the at least one opposing element, and passing the fiber web, in an unsupported manner, over a free draw from the smooth roll onto an embossing belt. The instant abstract is neither intended to define the invention disclosed in this specification nor intended to limit the scope of the invention in any way.

41 Claims, 4 Drawing Sheets

PROCESS AND APPARATUS FOR PRODUCING A FIBROUS WEB

CROSS-REFERENCE TO RELATED APPLICATIONS

The present application is a Continuation of U.S. patent application Ser. No. 10/299,781 filed Nov. 20, 2002 now U.S. Pat. No. 7,591,925 and claims priority under 35 U.S.C. §119 of German Patent Application No. 101 57 451.7 filed Nov. 23, 2001, the disclosures of which are expressly incorporated by reference herein in their entireties.

BACKGROUND OF THE INVENTION

1. Field of the Invention

The present invention relates to a method and an apparatus for producing a fibrous web, in particular a tissue or hygienic product web.

2. Discussion of Background Information

A method and an apparatus of this type are disclosed, for example, by German Patent Application No. DE 195 48 747 C2. The compact press disclosed by DE 195 48 747 C2 admittedly provides the necessary dewatering performance. Accordingly, a method of drying tissue is provided. However, if 100% of the fibrous web is led through such a press, then the desired paper quality properties, such as volume and water absorption capacity, in particular, are lost.

SUMMARY OF THE INVENTION

The present the invention provides an improved method and an improved apparatus of the type mentioned at the beginning with which a higher quality of the end product can be reached. In the process, a better quality is to be achieved in particular with regard to the volume (bulk) and the water absorption capacity.

According to the invention, the method of producing a fibrous web, in particular tissue or hygienic product web, includes guiding the fibrous web, together with a felt, through at least one press nip formed between a smooth roll and a respective opposing element, and passing the web from the smooth roll, unsupported over a free draw, onto an embossing belt, to which it is to pressed.

The free draw between smooth roll and embossing belt should be less than 50, preferably less than 30 mm, in the interests of stable guidance.

On the basis of this configuration, primarily an improved volume and an improved absorption capacity are achieved for the relevant fibrous web, that is to say in particular the relevant paper, tissue or hygienic product web. The method can be used in particular for tissue papers and, in particular, towel tissue. With wet embossing, the volume and the water absorption capacity are built up again. It is also advantageous in particular that, following wet embossing, it is possible to ensure with the embossing belt that only a small proportion of the fibrous web is pressed again, while a larger proportion of the fibrous web is no longer pressed.

Following the wet embossing, the fibrous web can be pressed against a drying cylinder. For this purpose, the fibrous web is guided, expediently together with the embossing belt, through a press nip formed between the drying cylinder and an opposing element. The fibrous web guided through the press nip is in contact with the surface of the drying cylinder and resting with its other side on the embossing belt.

According to an advantageous embodiment, the embossing belt accepts the fibrous web falling down from the smooth roll under the action of the force of gravity.

The fibrous web is preferably sucked into the surface structure of the embossing belt by a suction element arranged on the side of the embossing belt facing away from the fibrous web. In this case, the suction element is advantageously arranged in the area in which the embossing belt accepts the fibrous web.

The drying cylinder used can in particular be a Yankee cylinder, as it is known.

According to a preferred practical configuration of the method according to the invention, the fibrous web is guided on the smooth roll and preferably also wet creped at a dryness content in the range from about 25% to about 45%.

Use is preferably made of an embossing belt which is structured such that, for this embossing belt, the result is a smaller surface proportion of elevated or closed zones as compared with the surface proportion of set-back zones or holes, and accordingly a smaller surface proportion of the fibrous web is pressed. In this case, use is preferably made of an embossing belt in which the surface proportion of elevated or closed cells is ≦40% and preferably lies in a range from about 20% to about 30%.

The fibrous web is expediently guided over the drying cylinder at a dryness content in the range from about 35% to about 50%.

According to an expedient practical configuration, the fibrous web is preferably dry-creped at a dryness content of about 95% and then reeled.

The suction element used can in particular be an embossing box or the like.

In conjunction with the smooth roll, use can in particular be made of a doctor for separating the fibrous web from the smooth roll and for cleaning this roll. However, the doctor can also assist the transfer of the fibrous web or a strip thereof when starting up the machine.

It can likewise be advantageous for the doctor to be designed as a creping doctor, which permits the fibrous web to be wet creped.

According to an advantageous practical configuration of the method according to the invention, a press having two press nips is formed by using the smooth roll, in that this smooth roll is assigned a suction press roll or suction roll and a shoe press unit as opposing elements. The shoe press unit comprises a flexible belt guided over a press shoe in the area of the press nip. In this case, the shoe press unit used can in particular be a shoe press roll provided with a flexible roll cover. Here, the press nip of the shoe press unit should be longer than 80 mm, preferably longer than 120 mm in the web running direction, in the interests of good but gentle dewatering. In order not to reduce the volume too sharply, the maximum pressure in the press nip of the shoe press unit should be less than 2.5 MPa, preferably less than 1.6 MPa.

According to an advantageous expedient configuration, in each case the felt is also guided through the two press nips, together with the fibrous web.

An advantageous alternative configuration is distinguished by the fact that the fibrous web is guided together with the felt through the press nip formed between the smooth roll and the suction press roll or suction roll and is then guided together with the embossing belt through the press nip formed between the smooth roll and the shoe press unit. In this case, after the press nip formed between the smooth roll and the shoe press unit, the embossing belt can be separated again from the fibrous web guided onwards on the smooth roll, the embossing belt then accepting again the fibrous web falling downwards from the smooth roll under the action of the force of gravity.

According to a further advantageous refinement of the method according to the invention, using the smooth roll, a press having only one press nip is formed, by this smooth roll being assigned a shoe press unit as opposing element. The fibrous web is guided through this press nip together with the felt. In this case, the fibrous web is preferably sucked against the felt by means of a suction element arranged on the side of the felt facing away from the fibrous web and upstream of the press nip in the web running direction. The suction element used can in particular be a suction box or the like.

According to another expedient configuration of the method according to the invention, by using the smooth roll, a press having only one press nip is formed, by this smooth roll being assigned a suction press roll or suction roll as opposing element. The fibrous web is guided through this press nip together with the felt.

The embossing or structured belt used can in particular be an embossing wire or an embossing diaphragm or a Through-Air Drying (TAD) fabric.

The felt used is preferably a forming felt.

Furthermore, the present invention is directed to an apparatus for producing a fibrous web, in particular tissue or hygienic product web, in which the fibrous web is guided, together with a felt, through at least one press nip formed between a smooth roll and a respective opposing element, is wet creped on the smooth roll and is then pressed onto an embossing belt.

The invention can be applied in any desired formers and in particular in crescent formers, Duo formers, C-wrap formers, S-wrap formers.

The present invention is directed to a process for producing a fibrous web in an apparatus that includes at least one nip formed between a smooth roll and at least one opposing element, a felt and an embossing belt. The process includes guiding the fibrous web and the felt through the at least one press nip formed between the smooth roll and the at least one opposing element, passing the fiber web, in an unsupported manner, over a free draw from the smooth roll onto an embossing belt, and using a creping doctor in conjunction with the smooth roll.

According to a feature of the invention, the fiber web can include one of a tissue and hygienic product web.

In accordance with another feature of the invention, the process can include pressing the fibrous web onto the embossing belt after the free draw.

The process can also include separating the fibrous web from the smooth roll with the aid of a doctor.

Moreover, the free draw between smooth roll and the embossing belt can be less than 50 mm, and preferably the free draw between the smooth roll and the embossing belt is less than 30 mm.

In accordance with another feature of the invention, the felt may include a forming felt.

Further, the fibrous web may be wet embossed on the embossing wire, and, after the wet embossing, the process can also include pressing the fibrous web against a drying cylinder. A dryer press nip may be formed between the drying cylinder and an other opposing element, and the process may further include guiding the fibrous web together with the embossing belt through the dryer press nip. In the dryer press nip, a surface of the fibrous web can be in contact with a surface of the drying cylinder and the other surface of the fibrous web rests on the embossing belt. The drying cylinder can be a Yankee cylinder.

According to a further feature of the present invention, the embossing belt may accept the fibrous web falling downward from the smooth roll under the force of gravity.

The process may further include sucking the fibrous web into a surface structure of the embossing belt via a suction element arranged on a side of the embossing belt facing away from the fibrous web. The suction element can be arranged in a region in which the embossing belt accepts the fibrous web.

According to a still further feature of the instant invention, the process can include wet creping the fibrous web wet creped on the smooth roll at a dryness content in a range from about 25% to about 45%.

The process may also include that the embossing belt has a surface structure having a smaller surface proportion of elevated or closed zones compared with a surface proportion of set-back zones or holes, whereby a smaller surface proportion of the fibrous web is pressed. The embossing belt can include a surface proportion of elevated or closed zones of ≦40%, and preferably the surface proportion of elevated or closed zones lies in a range from about 20% to about 30%.

According to another feature of the invention, the process can include guiding the fibrous web over a drying cylinder at a dryness content in a range from about 35% to about 50%.

The process may also include dry creping the fibrous web at a dryness content of about 95% and reeling the dry creped fibrous web.

In accordance with another feature of the invention, the fibrous web may be suctioned onto the embossing belt by a suction element. The suction element may include an embossing box.

In accordance with still another feature of the invention, the at least one press nip can include a first and second nip and the at least one opposing element may include one of a suction press roll and a suction roll and a shoe press unit.

According to another feature of the invention, the felt may be guided, together with the fibrous web, through the first and second nips.

Moreover, the felt can be guided, together with the fibrous web, through the first press nip formed by the smooth roll and the one of the suction press roll and the suction roll, and the process may further include guiding the embossing belt, together with the fibrous web, through the second press nip formed by the smooth roll and the shoe press unit. After the second press nip, the process can further include separating the embossing belt from the fibrous web, which remains in contact with the smooth roll, and removing the fibrous web from the smooth roll to pass downwardly from the smooth roll under the force of gravity. The second press nip is longer than 80 mm in a web run direction, and preferably, the second press nip is longer than 120 mm in the web run direction. Further, a maximum pressure in the second press nip is less than 2.5 MPa, and preferably, the maximum pressure is less than 1.6 MPa.

Further still, the at least one press nip may include only one press nip and the at least one opposing element can include a shoe press unit, such that the felt, together with the fibrous web, is guided through the only one press nip. The only one press nip is longer than 80 mm in a web run direction, and preferably the only one press nip is longer than 120 mm in the web run direction. A maximum pressure in the only one press nip formed by the shoe press unit and the smooth roll is less than 2.5 MPa, and preferably, the maximum pressure is less than 1.6 MPa. Moreover, the fibrous web is sucked against the felt by a suction element arranged on a side of the felt facing away from the fibrous web in a region upstream, with regard to a web run direction, of the only press nip. The suction element can include a suction box.

The at least one press nip may include only one press nip formed by the smooth roll and the at least one opposing element may include one of a suction press roll and suction roll, and the felt, together with the fibrous web, is guided through the only one press nip.

The present invention is directed to an apparatus for producing a fibrous web. The apparatus includes a smooth roll and at least one opposing element. The smooth roll and the at least one opposing element are arranged to form at least one press nip. A felt is structured and arranged to guide the fibrous web through the at least one press nip and an embossing belt is structured and arranged to receive the fibrous web from the smooth roll. The smooth roll and the embossing belt are arranged such that the fibrous web passes in an unsupported manner over a free draw between the smooth roll and the embossing belt.

According to a feature of the instant invention, the fibrous web can include one of a tissue and a hygienic product web.

The apparatus can further include a device arranged to press the fibrous web onto the embossing belt.

In accordance with another feature of the invention, the felt can be a forming felt.

The free draw between the smooth roll and the embossing belt may be less than 50 mm, and preferably, the free draw is less than 30 mm.

According to the invention, the apparatus can include a drying cylinder arranged downstream, relative to a web run direction, of point at which the embossing belt receives the fibrous web. The drying cylinder can be positioned to form a dryer press nip with an other opposing element, and the fibrous web and the embossing belt may be guided through the drying press nip such that a surface of the fibrous web is in contact with a surface of the drying cylinder and the other surface of the fibrous web rests on the embossing belt. The drying cylinder can be a Yankee cylinder.

In accordance with another feature of the invention, the embossing belt can be arranged to accept the fibrous web as it falls downward from the smooth roll under the force of gravity.

The apparatus may also include a suction element located on a side of the embossing belt facing away from the fibrous web which is positioned to suck the fibrous web into a surface structure of the embossing belt. The suction element can be arranged in a region of a point at which the embossing belt accepts the fibrous web.

In accordance with still another feature of the present invention, a creping device may be arranged to wet crepe the fibrous web on the smooth roll at a dryness content in a range from about 25% to about 45%.

The embossing belt can be structured to exhibit a smaller surface proportion of elevated or closed zones compared with a surface proportion of set-back zones or holes, whereby a smaller surface proportion of the fibrous web is pressed. A surface proportion of the embossing belt of elevated or closed zones can be ≦40%, and preferably, the surface proportion lies in a range from about 20% to about 30%.

According to a further feature of the instant invention, a drying cylinder can be arranged so that the fibrous web is guided over the drying cylinder at a dryness content in a range from about 35% to about 50%.

In accordance with a still further feature, a creping device can be arranged to dry-crepe the fibrous web at a dryness content of about 95% and a reeling device to reel the dry-creped fibrous web.

Moreover, a suction element can be arranged to suction the fibrous web onto the embossing element. The suction element comprises an embossing box.

According to still another feature of the present invention, a doctor may be arranged to separate the fibrous web from the smooth roll.

The at least one press nip can include a first and a second press nip and the at least one opposing element may include one of a suction press roll or a suction roll and a shoe press unit. The felt may be structured and arranged to guide the fibrous web through the first and second press nips. The felt can be structured and arranged to guide the fibrous web through the first press nip formed by the smooth roll and the one of the suction press roll or suction roll and the embossing belt may be structured and arranged to guide the fibrous web through the second press nip formed between the smooth roll and the shoe press unit. After the second press nip, the embossing belt can be separated from the fibrous web, which remains in contact with the smooth roll, and the embossing belt may be further guided to accept the fibrous web passing downwardly from the smooth roll under the force of gravity. Further, the second press nip is longer than 80 mm in a web run direction, and preferably, the second press nip is longer than 120 mm in the web run direction. Further still, a maximum pressure in the second press nip is less than 2.5 MPa, and preferably, the maximum pressure is less than 1.6 MPa.

Moreover, the at least one press nip may include only one press nip and the at least one opposing element can include a shoe press unit, and the felt is structured and arranged to guide the fibrous web through the only one nip. The only one press nip is longer than 80 mm in a web run direction, and preferably, the only one press nip is longer than 120 mm in the web run direction. Further, a maximum pressure in the only one press nip is less than 2.5 MPa, and preferably, the maximum pressure is less than 1.6 MPa. Still further, a suction element can be arranged on a side of the felt facing away from the fibrous web, the suction element may be located upstream of the only one press nip in the web run direction and positioned to suck the fibrous web against the felt. The suction element can include a suction box.

In accordance with still yet another feature of the present invention, the at least one press nip can include only one nip and the at least one opposing element can include one of a suction press roll or suction roll, and the felt may be structured and arranged to guide the fibrous web through the only one press nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DETAILED DESCRIPTION OF THE EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
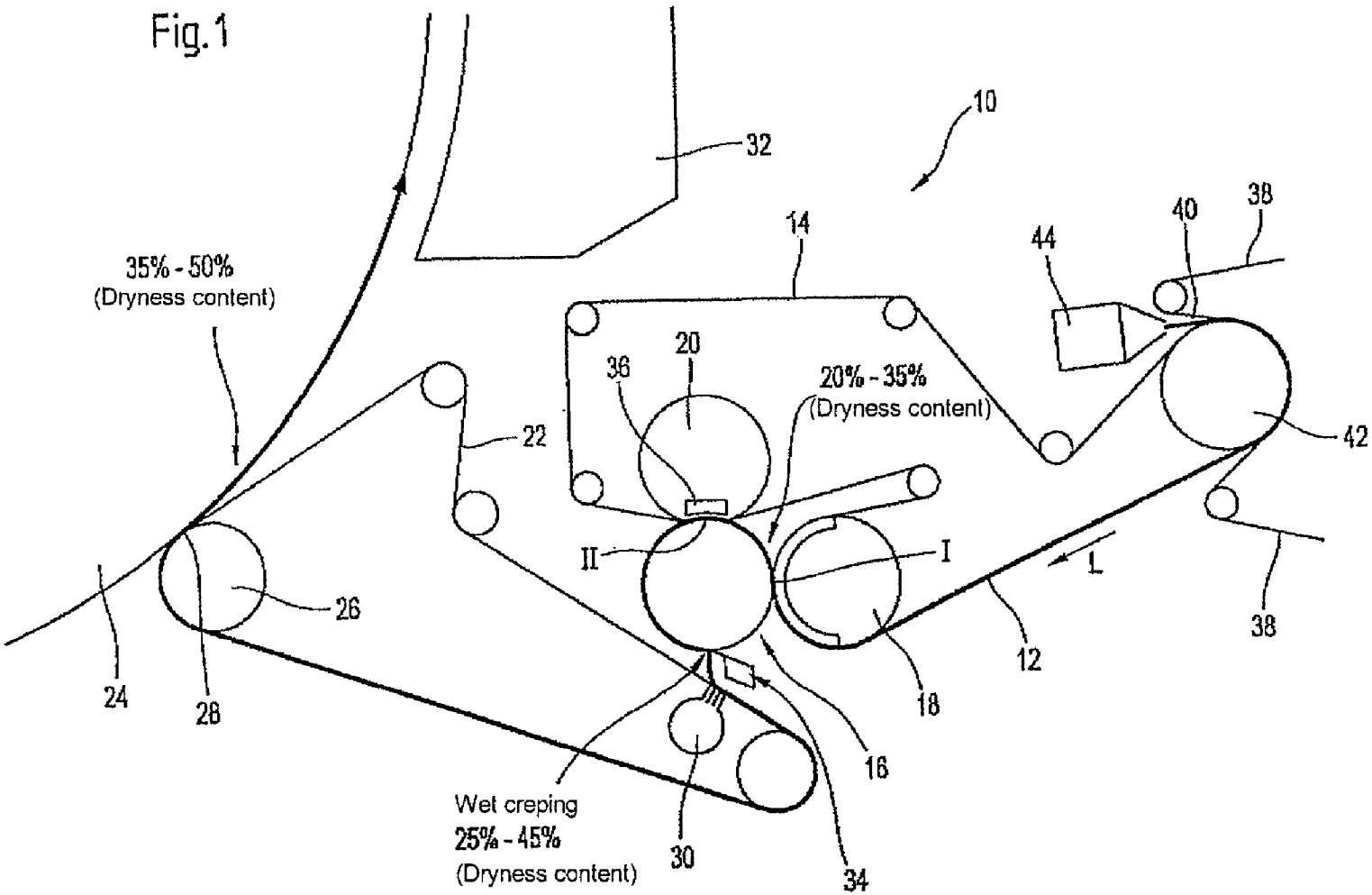
FIG. 1 illustrates a schematic partial representation of an apparatus for producing a fibrous web, in which the smooth roll is assigned a suction press roll or suction roll and a shoe press unit in form a press with two press nips.

FIG. 1 shows a schematic partial representation of an apparatus 10 for producing a fibrous web 12, which can be in particular a tissue or hygienic product web.

In the illustrated embodiment, fibrous web 12 is guided together with a felt 14 through at least one, e.g., two, press nips I and II formed between a smooth roll 16 and respective opposing elements 18 and 20. Fibrous web 12 is wet creped on smooth roll 16 and pressed onto an embossing belt 22 following a free draw from smooth roll 16. The free draw has a length of about 30 mm.

Following the wet creping and wet embossing, fibrous web 12 is pressed against a drying cylinder 24, which may in particular be a Yankee cylinder, as it is known. In the process, fibrous web 12, together with embossing belt 22, is guided through a press nip 28 formed between drying cylinder 24 and an opposing element 26. In the illustrated embodiment, fibrous web 12, guided through press nip 28, is in contact with the surface of drying cylinder 24, with its other side resting on embossing belt 22.

The wet creping of fibrous web 12 is carried out at a dryness content in the range from 25 to 45%.

Embossing belt 22 accepts fibrous web 12 falling downward from smooth roll 16 under the action or force of gravity. In the area of this transfer point, a suction element 30 is arranged on the side of embossing belt 22 facing away from fibrous web 12, so that fibrous web 12 is sucked and therefore pressed into the surface structure of embossing belt 22.

Embossing belt 22 can in particular be structured to exhibit a smaller surface proportion of elevated or closed zones as compared with the surface proportion of set-back zones or holes, such that a smaller surface proportion of fibrous web 12 will be pressed by embossing belt 22.

The surface proportion of elevated or closed zones on the embossing belt 22 can in particular be ≦40% and preferably lies in a range from about 20% to about 30%.

Fibrous web 12 can be guided over drying cylinder 24 in particular at a dryness content in the range from about 35% to about 50%. As is illustrated in FIG. 1, a drying hood 32 can be assigned to drying cylinder 24.

Fibrous web 12 can then preferably be dry-creped at a dryness content of about 95% and then reeled.

Suction element 30 provided can in particular be an embossing box.

As illustrated in FIG. 1, smooth roll 16 is assigned a doctor 34 for wet creping and therefore also for separating fibrous web 12 from smooth roll 16 and for cleaning smooth roll 16.

In the present exemplary embodiment, smooth roll 16 is assigned a suction press roll or suction roll 18 and a shoe press unit 20 as opposing elements to form a compact press having two press nips I and II. Shoe press unit 20 comprises a flexible belt guided over a press shoe 36 in the area of press nip II. In this case, shoe press unit 20 provided can in particular be a shoe press roll provided with a flexible roll cover.

In the present embodiment, felt 14 is guided through press nips I and II together with fibrous web 12. As can be seen in FIG. 1, felt 14 is separated from fibrous web 12 in the area between press nips I and II, while fibrous web 12 remains in contact with smooth roll 16.

Moreover, a former having two circulating dewatering belts 14 and 38 is depicted in the exemplary illustration as including an inner belt formed by belt 14, e.g., a former felt. Dewatering belts 14 and 38 run together, forming a stock inlet gap 40, and are guided over a forming element 42, e.g., a forming roll. Fibrous suspension is introduced into stock inlet gap 40 by a flowbox (headbox) 44.

Smooth roll 16 has a smooth or closed surface (flat and release surface). Embossing belt 42 used can be, for example, an embossing wire or an embossing diaphragm or a TAD fabric.

As indicated in FIG. 1, the dryness content of fibrous web 12 immediately after first press nip I can lie, for example, in a range from about 20% to about 35%. Moreover, fibrous web 12 is preferably guided over drying cylinder 24 at a dryness content in the range from about 35% to about 50%.

In principle, any desired types of formers are conceivable. Thus, the invention can be applied, for example, in crescent formers, Duo formers, C-wrap formers, S-wrap formers and so on.

Figure 2:
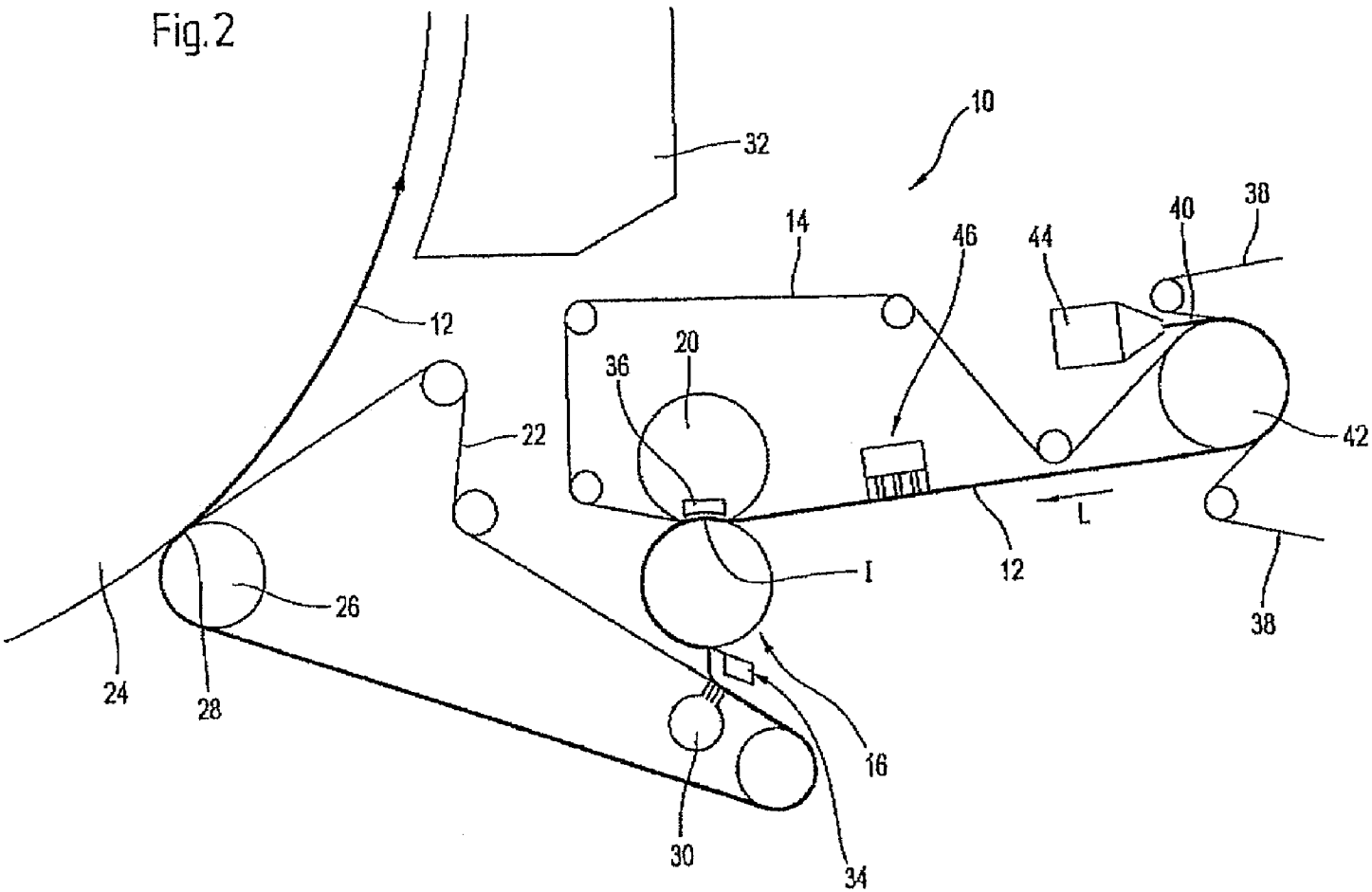
FIG. 2 illustrates a schematic partial representation of a further embodiment of the apparatus, in which the smooth roll is assigned a shoe press unit to form only press nip.

FIG. 2 illustrates a schematic representation of another embodiment of apparatus 10. In this embodiment, smooth roll 16 is assigned a shoe press unit 20 as opposing element to form a press having only press nip I. In this manner, it is possible for shoe press unit 20 to again be in particular a shoe press roll. Fibrous web 12 is guided through press nip I together with felt 14.

On the side of felt 14 facing away from fibrous web 12, and upstream of press nip I in the web running direction L, a suction element 46, for example, a suction box or the like, is provided, by which fibrous web 12 is sucked against felt 14.

Otherwise, as the embodiment of FIG. 2 has at least substantially the same structure as that in FIG. 1, mutually corresponding parts being assigned the same reference symbols.

Figure 3:
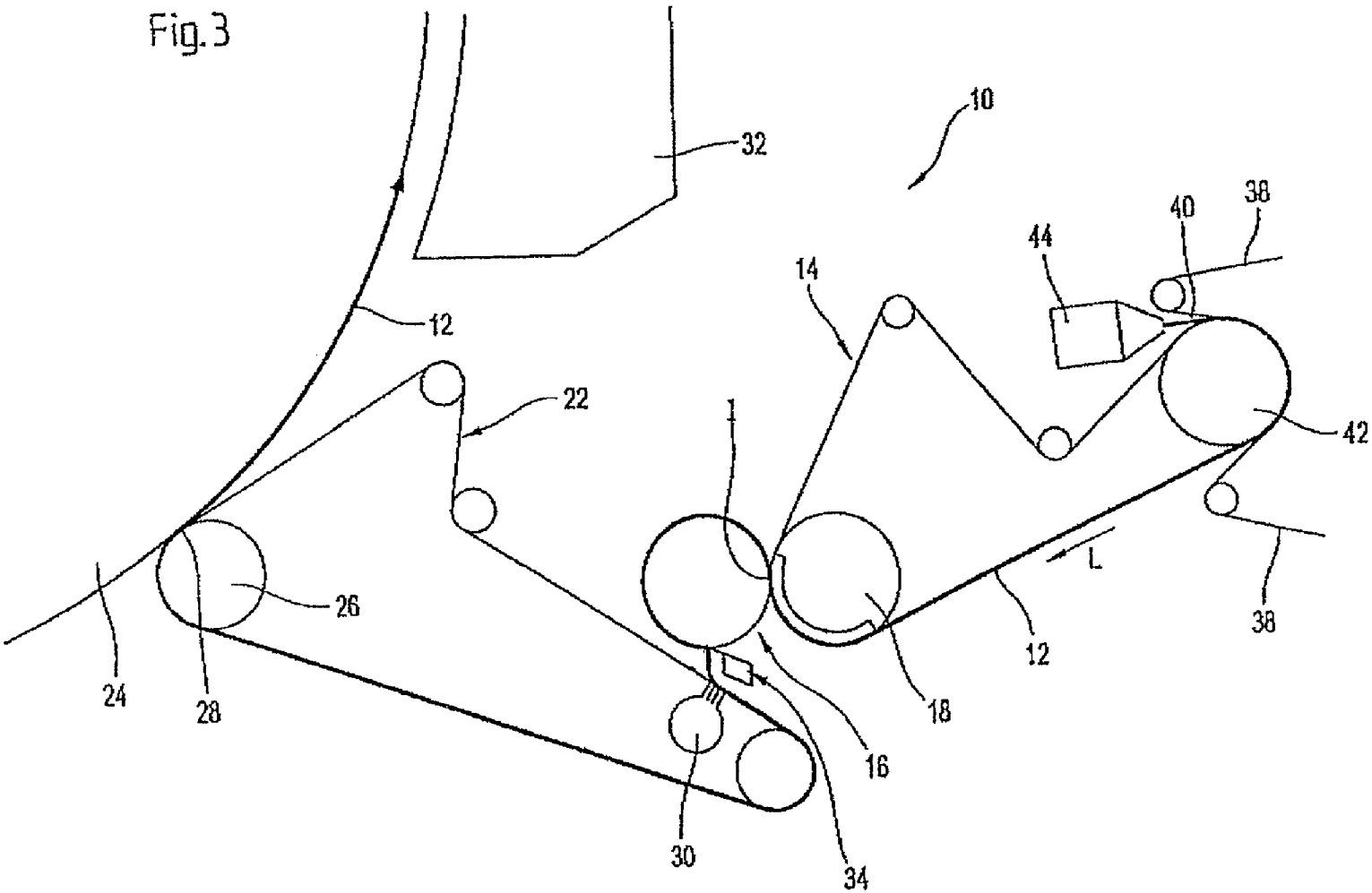
FIG. 3 illustrates a schematic partial representation of a further embodiment of the apparatus, in which the smooth roll is assigned a suction press roll or suction roll to form only one press nip.

FIG. 3 illustrates a schematic representation of a further embodiment of apparatus 10. In this embodiment, smooth roll 16 is assigned a suction press roll or suction roll 18 as opposing element to form a press having only press nip I. Fibrous web 12 is guided through press nip I together with felt 14.

Otherwise, as this embodiment has at least substantially the same structure as that depicted in FIG. 1, mutually corresponding parts being assigned the same reference symbols.

Figure 4:
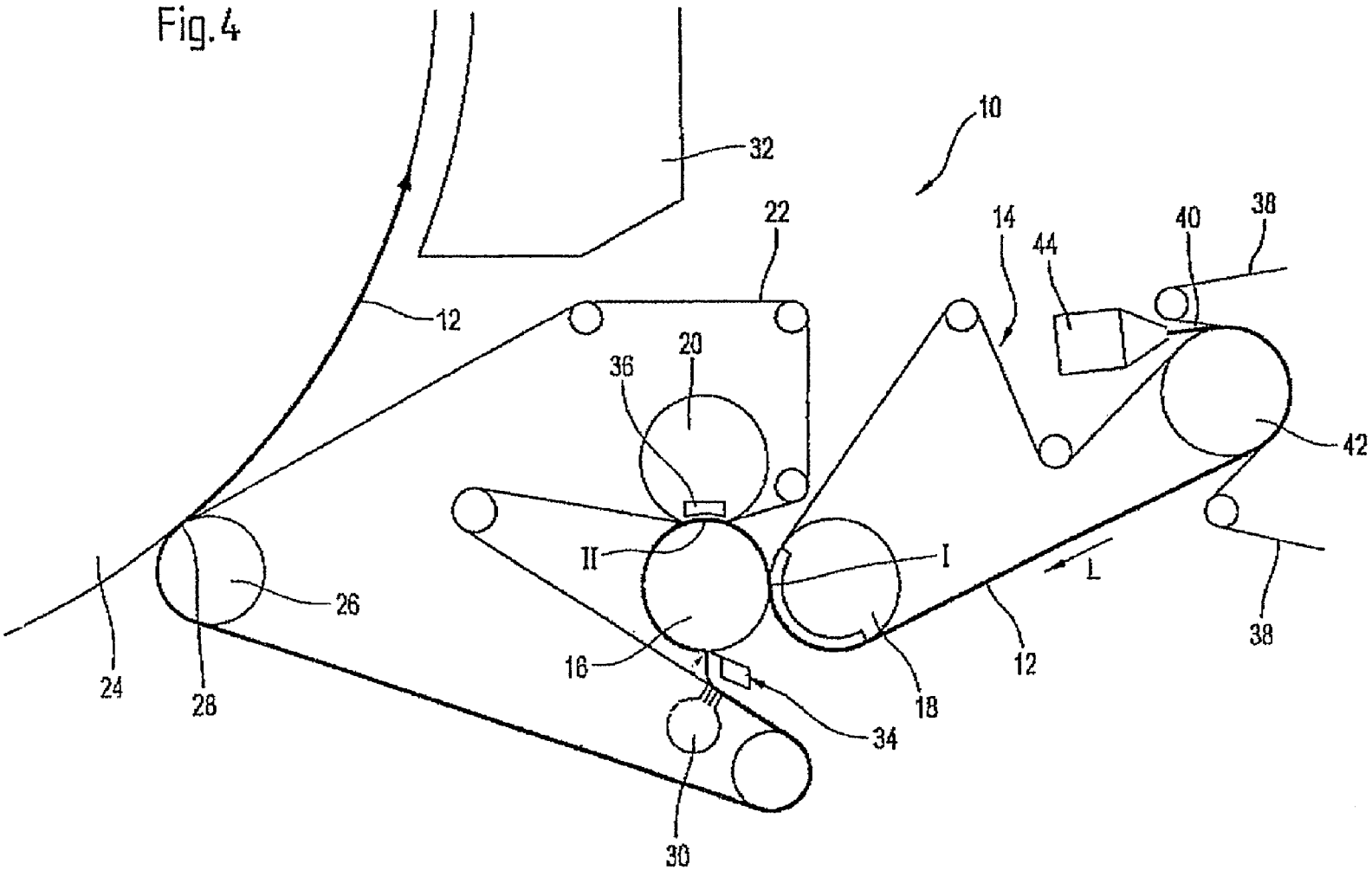
FIG. 4 illustrates a schematic partial representation of a further embodiment of the apparatus, in which the smooth roll is assigned a suction press roll or suction roll and a shoe press unit to form a press with two press nips.

FIG. 4 illustrates a schematic partial representation of an embodiment of apparatus 10 in which smooth roll 16 is assigned a suction press roll or suction roll 18 and a shoe press unit 20 as opposing elements to form a compact press having two press nips I and II. In this embodiment, however, fibrous web 12 is guided together with felt 14 through press nip I formed between smooth roll 16 and suction press roll or suction roll 18 and is then guided together with embossing belt 22 through press nip II formed between smooth roll 16 and shoe press unit 20.

As can be seen by using FIG. 4, after press nip II, formed between smooth roll 16 and shoe press unit 20, embossing belt 22 is separated from fibrous web 12, while fibrous web 12 remains in contact with smooth roll 16. Subsequently, fibrous web 12, falling downward from smooth roll 16 under the force of gravity, is again accepted by embossing belt 22.

Otherwise, as the embodiment of FIG. 4 has at least substantially the same structure as that depicted in FIG. 1, mutually corresponding parts being assigned the same reference symbols.

In each depicted embodiment, doctor 34 can be used in accordance with the requirements for wet creping, separating and/or transferring the fibrous web 12 and/or for cleaning smooth roll 16.

The press nip of shoe press unit 20 has a length of about 100 mm and a maximum pressure below 2 MPa.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A process of producing a fibrous web in an apparatus that includes at least one nip formed between a smooth roll and at least one opposing element, a felt and an embossing belt, the process comprising:

guiding the fibrous web and the felt through the at least one press nip formed between the smooth roll and the at least one opposing element;

passing the fiber web, in an unsupported manner, over a free draw from the smooth roll onto an embossing belt;

embossing the fiber web by sucking the fibrous web into a surface structure of the embossing belt; and using a creping doctor in conjunction with the smooth roll.

2. The process in accordance with claim 1, wherein the fiber web comprises one of a tissue and hygienic product web.

3. The process in accordance with claim 1, further comprising pressing the fibrous web onto the embossing belt after the free draw.

4. The process in accordance with claim 1, further comprising separating the fibrous web from the smooth roll with the aid of the creping doctor.

5. The process in accordance with claim 1, wherein the free draw between smooth roll and the embossing belt is less than 50 mm.

6. The process in accordance with claim 5, wherein the free draw between the smooth roll and the embossing belt is less than 30 mm.

7. The process in accordance with claim 1, wherein the felt comprises a forming felt.

8. The process in accordance with claim 1, wherein the fibrous web is wet embossed on the embossing wire, and, after the wet embossing, the process further comprises pressing the fibrous web against a drying cylinder.

9. The process in accordance with claim 8, wherein a dryer press nip is formed between the drying cylinder and an other opposing element, and the process further comprises guiding the fibrous web together with the embossing belt through the dryer press nip.

10. The process in accordance with claim 9, wherein, in the dryer press nip, a surface of the fibrous web is in contact with a surface of the drying cylinder and the other surface of the fibrous web rests on the embossing belt.

11. The process in accordance with claim 8, wherein the drying cylinder comprises a Yankee cylinder.

12. The process in accordance with claim 1, wherein the embossing belt accepts the fibrous web falling downward from the smooth roll under the force of gravity.

13. The process in accordance with claim 1, wherein a suction element is arranged on a side of the embossing belt facing away from the fibrous web.

14. The process in accordance with claim 13, wherein the suction element is arranged in a region in which the embossing belt accepts the fibrous web.

15. The process in accordance with claim 1, further comprising wet creping the fibrous web wet creped on the smooth roll at a dryness content in a range from about 25% to about 45%.

16. The process in accordance with claim 1, wherein the embossing belt has a surface structure having a smaller surface proportion of elevated or closed zones compared with a surface proportion of set-back zones or holes, whereby a smaller surface proportion of the fibrous web is pressed.

17. The process in accordance with claim 16, wherein the embossing belt comprises a surface proportion of elevated or closed zones of $\leqq 40\%$.

18. The process in accordance with claim 17, wherein the surface proportion of elevated or closed zones lies in a range from about 20% to about 30%.

19. The process in accordance with claim 1, further comprising guiding the fibrous web over a drying cylinder at a dryness content in a range from about 35% to about 50%.

20. The process in accordance with claim 1, further comprising dry creping the fibrous web at a dryness content of about 95% and reeling the dry creped fibrous web.

21. The process in accordance with claim 1, wherein the fibrous web is suctioned into the surface structure of the embossing belt by a suction element.

22. The process in accordance with claim 21, wherein the suction element comprises an embossing box.

23. The process in accordance with claim 1, wherein the at least one press nip comprises a first and second nip and the at least one opposing element comprises one of a suction press roll and a suction roll and a shoe press unit.

24. The process in accordance with claim 1, wherein the felt is guided, together with the fibrous web, through the first and second nips.

25. The process in accordance with claim 1, wherein the felt is guided, together with the fibrous web, through the first press nip formed by the smooth roll and the one of the suction press roll and the suction roll, and the process further comprises guiding the embossing belt, together with the fibrous web, through the second press nip formed by the smooth roll and the shoe press unit.

26. The process in accordance with claim 25, wherein, after the second press nip, the process further comprises separating the embossing belt from the fibrous web, which remains in contact with the smooth roll, and removing the fibrous web from the smooth roll to pass downwardly from the smooth roll under the force of gravity.

27. The process in accordance with claim 26, wherein the second press nip is longer than 80 mm in a web run direction.

28. The process in accordance with claim 27, wherein the second press nip is longer than 120 mm in the web run direction.

29. The process in accordance with claim 26, wherein a maximum pressure in the second press nip is less than 2.5 MPa.

30. The process in accordance with claim 29, wherein the maximum pressure is less than 1.6 MPa.

31. The process in accordance with claim 1, wherein the at least one press nip comprises only one press nip and the at least one opposing element comprises a shoe press unit, such that the felt, together with the fibrous web, is guided through the only one press nip.

32. The process in accordance with claim 31, wherein the only one press nip is longer than 80 mm in a web run direction.

33. The process in accordance with claim 32, wherein the only one press nip is longer than 120 mm in the web run direction.

34. The process in accordance with claim 31, wherein a maximum pressure in the only one press nip formed by the shoe press unit and the smooth roll is less than 2.5 MPa.

35. The process in accordance with claim 34, wherein the maximum pressure is less than 1.6 MPa.

36. The process in accordance with claim 31, wherein the fibrous web is sucked against the felt by a suction element arranged on a side of the felt facing away from the fibrous web in a region upstream, with regard to a web run direction, of the only press nip.

37. The process in accordance with claim 36, wherein the suction element comprises a suction box.

38. The process in accordance with claim 1, wherein the at least one press nip comprises only one press nip formed by the smooth roll and the at least one opposing element comprises one of a suction press roll and suction roll, and the felt, together with the fibrous web, is guided through the only one press nip.

39. The process in accordance with claim 1, wherein the fibrous web is not mechanically compacted on the embossing belt before contacting a Yankee cylinder.

40. The process in accordance with claim 1, wherein, before contacting a drying cylinder, the fibrous web sucked into the surface structure of the embossing belt and the embossing belt are not guided through a press nip.

41. The process in accordance with claim 1, wherein the embossing comprises a wet embossing upstream of a drying cylinder and the wet embossing does not include a mechanical pressing of the fibrous web and embossing belt.

* * * * *